US005220966A

United States Patent [19]

Awdujewski et al.

[11] Patent Number: 5,220,966

[45] Date of Patent: Jun. 22, 1993

[54] DRILLING APPARATUS OF THE CUTTING AND SHEARING TYPE

[75] Inventors: Wsewolod S. Awdujewski; Rifner W. Ganijew, both of Moskau; Robert S. Mufasalow, BaSSR; Jurij P. Sacharow, Moskau, all of U.S.S.R.

[73] Assignee: Wave Tec G.m.b.H., Laxenburg, Austria

[21] Appl. No.: 878,475

[22] Filed: May 5, 1992

[30] Foreign Application Priority Data

May 6, 1991 [SU] U.S.S.R. ..... 4928470

[51] Int. Cl.[5] ..... E21B 10/18

[52] U.S. Cl. ..... 175/339

[58] Field of Search ..... 175/331, 339, 340, 393

[56] References Cited

U.S. PATENT DOCUMENTS 3,144,087 8/1964 Williams, Jr. ..... 175/339

4,673,045 6/1987 McCullough ..... 175/339

FOREIGN PATENT DOCUMENTS 1104231 7/1984 U.S.S.R. ..... 175/339

*Primary Examiner*—Thuy M. Bui

*Attorney, Agent, or Firm*—Rothwell, Figg, Ernst & Kurz

[57] ABSTRACT

The drilling apparatus according to the invention contains a body (1) and rock-destroying organs (3) of the cutting and shearing type that are attached to the matrix (2) of the body. The body (1) is provided with a turbulence chamber (4) with tangentially aligned entry channels (5) and a central outlet channel (6). Tangentially arranged outlet channels (9) are designed in the lower part of the body (1). The part of the matrix (2) closest to the body (1) is designed in the form of a hollow truncated cone with its top surface (12) turned toward the body (1). The sphere is designed with a changing slope of the generatrices (10) of the conical surface and with the bottom surface (11) and the top surface (12) designed according to the Archimedean spiral. On the lateral surface of the matrix (2) there are continuous radial grooves (13) that are connected to the outlet channels (9) by a cavity (14) designed in the body (1).

4 Claims, 3 Drawing Sheets

FIG.1
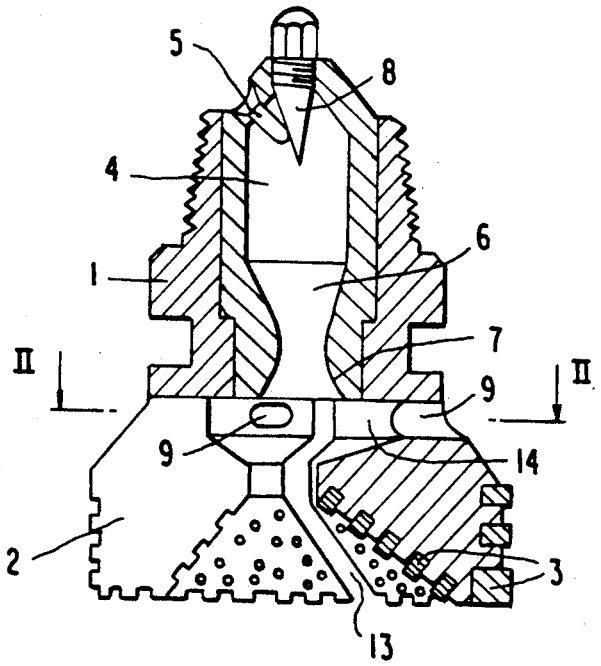
FIG.2
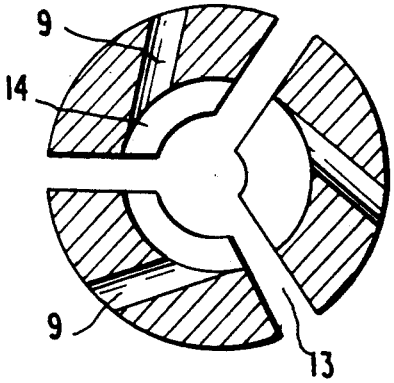
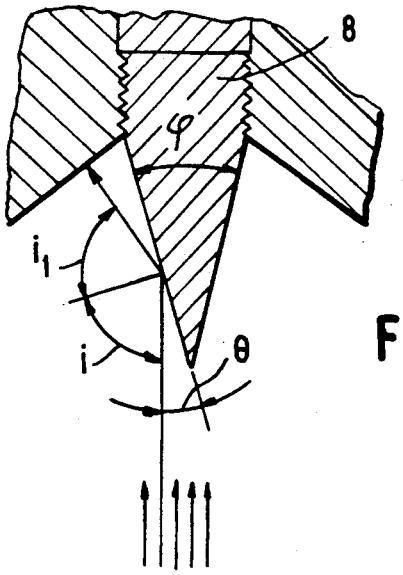
FIG.3

FIG.7
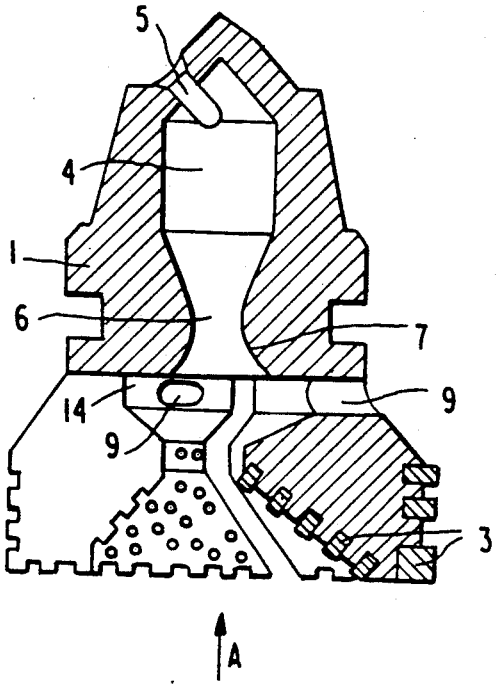
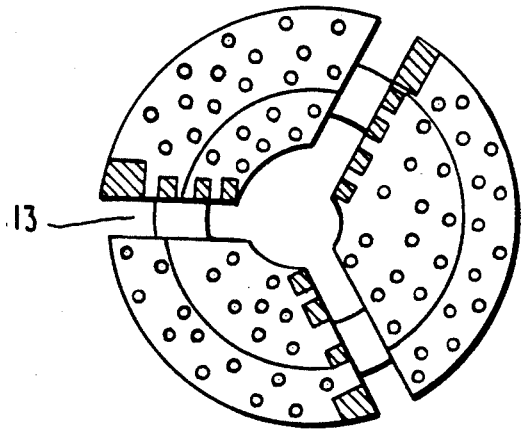
FIG.8
FIG.9
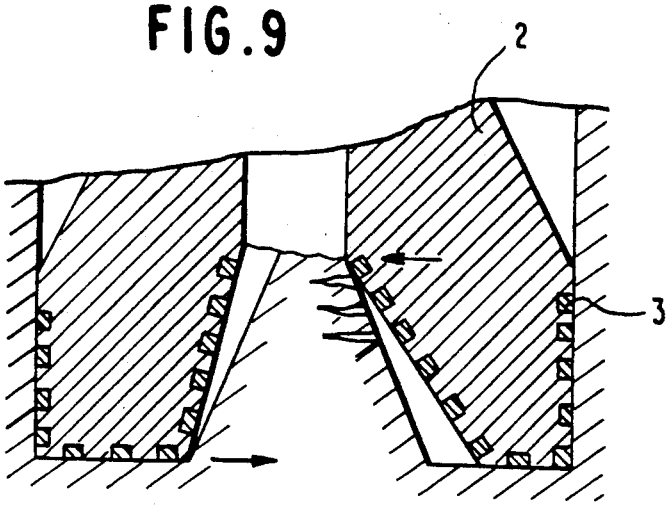

DRILLING APPARATUS OF THE CUTTING AND SHEARING TYPE

TECHNICAL FIELD

The present invention refers to a rock-destroying drilling tool and in particular to a drilling bit of the cutting and shearing type.

State of the art taken as a basis

There is a familiar drilling apparatus (N.I. Andrianov, E.S. Bubnov et al "Almaznoe burenie" (diamond drills), 1961, "Gostoptekhizdat" Editions (Moscow), p. 158, FIG. 54) that contains a hollow body with channels for supplying a drilling liquid and rock-destroying organs of the cutting and shearing type. The rock-destroying organs are attached at the lower part of the body—to a matrix. In the central part of the matrix there is a countersinking with radial grooves designed on its frontal surface for removing drillings. The conical cavity of the matrix and the radial grooves communicate with the channels to supply the drilling liquid. Wear-resistant teeth of the cutting and shearing type are attached to the surface of the matrix that touches the drill hole floor.

Known drilling apparatuses do not ensure an increase in mechanical drilling speed and bit base length nor an increase in effectiveness of the overall sinking of a drill hole for the following reasons:

- the system of the flushing channels designed for the drilling liquid in the body does not effectively clean drillings from the floor of the drill hole nor does it cool the rock-destroying organ;
- the geometric shape of the design of the matrix of the rock-destroying organ does not guarantee effective destruction of the rock nor the required service life of destruction of the rock nor the required service life of the drilling tool.

Disclosure of the Invention

The invention is based on the task of creating a drilling apparatus of the cutting and shearing type with the body and its matrix and the system of flushing channels designed to guarantee the production and utilization of the high level of wave energy with directed effect of hydrodynamic waves that are created by a turbulent current of drilling liquid and have a broad frequency spectrum in the zone near the drill hole, and to guarantee the creation of a partial vacuum in this zone.

The task thus presented is solved according to the invention as follows: in the drilling apparatus of the cutting and shearing type, which contains a body with channels for supplying a drilling liquid and rock-destroying organs of the cutting and shearing type attached to the matrix of the body, the body is equipped with a turbulence chamber with, in its upper part, tangentially arranged entry channels and a central outlet channel, with tangentially arranged outlet channels designed in the lower part of the body. In this setup, the part of the matrix closest to the body is designed in the shape of a hollow, truncated cone with the top surface turned toward the body and with a changing slope of the generatrices of the conical surface and with the bottom and top surfaces shaped according to the Archimedean spiral. On the lateral surface of the matrix there are continuous radial grooves that are connected to the outlet channels of the body by a cavity designed in the body.

The equipping of the bit body with the turbulence chamber with tangentially directed entry channels is determined by the need to generate hydroacoustic waves to activate the rock destruction process. The turbulence chambers constitute strong hydrodynamic wave radiators with a broad frequency spectrum. In addition, the turbulence chambers create a partial vacuum in the zone near the drill hole, which promotes the destruction process and a cleaning of mud from the floor of the drill hole.

The central outlet channel and the radial grooves are for transferring the wave energy to the surface of the drill hole floor and for aligned flushing of this surface.

The concave conical surface of a part of the matrix contributes to a reduction in energy intensity in the destruction of the central part of the drill hole floor. In the drilling process, there remains a protruding part of the drill hole floor in the form of a regular cone. In connection with the changing slope of the conical surface of the matrix, an additional alternating bending force acts on the protruding part of the drill hole floor when the drill tool is rotated, which leads to a volumetric destruction. In addition, the central part of the drill hole floor is intensively destroyed by the wave energy. The design of the bottom and top surfaces of the truncated cone according to the Archimedean spiral makes it possible to change the slope of the generatrices of the conical surface.

It is useful to have the turbulence chamber designed in a spherical shape.

The choice of a spherical shape for the turbulence chamber is due to the higher amplitude of the waves generated by spherical radiators working in self-oscillation operation with a periodical hydraulic self-blocking of the outlet channel.

It is preferable for the turbulence chamber to be equipped with a conical wave reflector arranged in its upper part in the direction of its longitudinal axis, with the cone taper of the conical wave reflector following the relation $$0<\phi\leqq 20'$$

where $\phi$ is the cone taper of the wave reflector;

$0'$ is the critical angle of approach of a wave coming in to the wave reflector.

Equipping the turbulence chamber with the conical wave reflector makes it possible to prevent hydroacoustic and cavitation wear on the central part of the chamber and to increase the service life of the drilling apparatus.

The cone taper of the conical wave reflector is chosen equal to or less than twice the value of the critical angle of approach 20, of the incident wave, i.e., $0<\phi\leqq 20'$, because the boundary surface of the two media (drilling liquid and metal) with different density and compressibility levels constitutes a reflective, absorptive, breaking surface. If the angle of approach 0 of the incident wave is not greater than the critical angle of approach $0'$, i.e., $0<0'$, then a total reflection takes place. Such a wave does not transfer any energy from the first medium (drilling liquid) to the second medium (metal), and therefore the total energy of the incident wave is reflected and scattered back to the first medium. The cosine of the critical angle of approach $0'$ is equal to the refractive index of the second medium with respect to the first medium:

$$\cos 0' = n = c/c_1,$$

where n is the refractive index;

c is the acoustic velocity in the drilling liquid;

$c_1$ is the acoustic velocity in the metal;

It is preferable to design the central outlet channel with a conical taper and its frontal surface rounded off.

The design of the frontal surface of the central outlet channel with a radial rounding off is based on the need to keep hydraulic losses low when steering the drilling liquid through the tangential outlet channels into the torus, and this also improves the efficiency of the vacuum in the zone near the drill hole.

BRIEF DESCRIPTION OF THE DRAWINGS

The present invention is explained in greater detail below in a concrete form of construction with the attached drawings. Shown are:

FIG. 1: the complete view of a drilling apparatus of the cutting and shearing type according to the invention with a conical wave reflector;

FIG. 2: a II—II view according to FIG. 1;

FIG. 3: the conical wave reflector according to the invention;

FIG. 7: the complete view of the drilling apparatus of the cutting and shearing type according to the invention, with the turbulence chamber designed in the body of the drilling tool;

FIG. 8: an A view for FIG. 7;

FIG. 9 the profile of a cross-section of the drill hole floor and a sketch of the action of an additional force on a protrusion of the rock.

Figure 4:
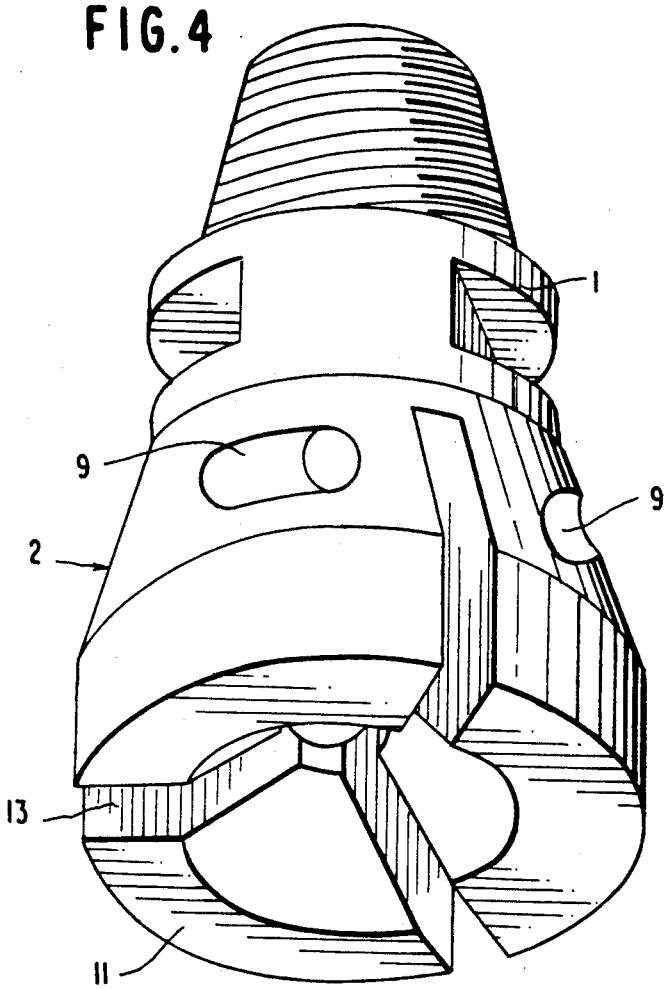
FIG. 4: a matrix in axonometric representation.

Optimal form of construction of the invention

The drilling apparatus of the cutting and shearing type according to the invention contains a body 1 (FIGS. 1, 2) with rock-destroying organs 3 of the cutting and shearing type attached to its matrix 2. The body 1 is provided with a turbulence chamber 4 with tangentially arranged entry channels 5 and a conically tapering central outlet channel 6 the frontal surface 7 of which is designed radially rounded off. The turbulence chamber 4 is equipped with a conical wave reflector 8. The conical taper $\phi$ (FIG. 3) of the surface of the wave reflector 8 is determined by the relation $$0 < \phi \leqq 20'$$

where 0' is the critical angle of approach of a wave coming in to the reflector.

Figure 5:
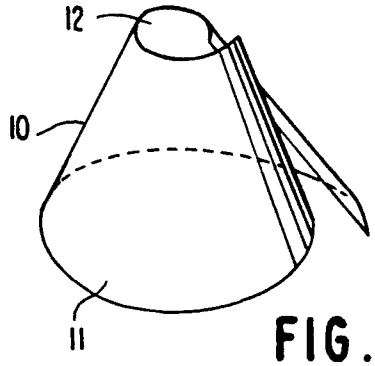
FIG. 5: the design of the conical surface of a part of the matrix of the body according to the invention.

Tangentially directed outlet channels 9 are designed in the lower part of the body 1. The part of the matrix 2 (FIGS. 1, 4) closest to the body 1 is designed in the form of a hollow truncated cone with a changing slope of the generatrices 10 (FIG. 5) and with the bottom and top surfaces (11, 12) shaped according to the Archimedean spiral, while the top surface (12) is turned toward the body 1. On the lateral surface of the matrix 2 there are radial grooves 13 that are connected to the outlet channels 9 through a cavity 14 designed in the body 1.

Figure 6:
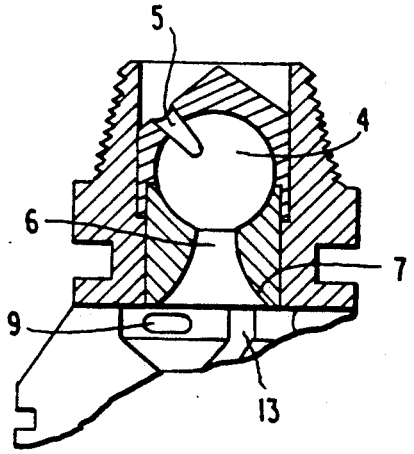
FIG. 6: the body of the drilling tool according to the invention with the spherical cavity of a turbulence chamber.

The cavity of the turbulence chamber 4 (FIG. 6) can have a spherical shape. In addition, the turbulence chamber 4 (FIG. 7) can be designed in the body 1 itself.

The drilling apparatus of the cutting and shearing type according to the invention works as follows. The drilling liquid is directed through a drill string into the tangentially directed entry channels 5 (FIG. 1). The drilling liquid then flows into the turbulence chamber 4. In the turbulence chamber 4 the drilling liquid is made to rotate at a rotating frequency of $5.10^2$ to $8.10^2$ $s^{-1}$. The rotating drilling liquid is directed through the outlet channels 9 and the radial grooves 13 into the torus.

The intensity of rotation of the drill liquid increases suddenly at the exit of the outlet channel 6. The drilling liquid is conveyed in radially diverging directions into the torus by the kinetic energy of the turbulent current. In the process, a partial vacuum is created in the turbulence chamber 4 and in the central zone of the floor. Owing to a periodical break-through of the drill liquid from the zone near the drill hole into the turbulence chamber 4, powerful hydrodynamic pulsations of the self-oscillation type are created in the zone near the drill hole. The amplitude and frequency of the generated waves depend on the geometric parameters of the turbulence chamber 4, the pressure difference, and the density and quantity of the liquid to be pumped through.

The hydroacoustic waves generated by the installation are propagated mainly in two directions: inward in the turbulence chamber 4 and to the floor of the drill hole. The hydroacoustic waves directed inward are absorbed by the conical wave reflector 8, totally reflected by its conical surface and scattered in the drilling liquid, and have no destructive action on the head of the turbulence chamber 4. In this way, operating safety and service life of the apparatus are increased, while the hydroacoustic waves directed to the floor of the drill hole intensively destroy the central part of the floor of the drill hole and are more effective in many types of rock than a dentiform mechanical rock-destruction.

The use of the drilling apparatus referred to in the patent application makes it possible to substantially increase the mechanical drilling speed and the bit base length compared to the prototypes and the best drilling apparatuses that can be used.

The effectiveness is obtained by creating a high level of wave energy with a directed effect in the zone near the drill hole. Furthermore, the present apparatus allows for wave colmation of the drill hole wall when passing through geologically complicated horizons (in areas with caving or absorption, and in the case of water, petroleum or natural gas egress).

Industrial application

The invention can be used in the sinking of drill holes using rock-destroying organs of the cutting and shearing type.

We claim:

1. Drilling apparatus of the cutting and shearing type containing a body (1) with channels for supplying a drilling liquid and rock-destroying organs (3) of the cutting and shearing type attached to the matrix (2) of the body (1), characterized in that the body (1) is equipped with a turbulence chamber 94) with entry channels (5) tangentially arranged in its upper part and a central outlet channel (6), and that tangentially arranged outlet channels (9) are designed in the lower part of the body (1), with the part of the matrix (2) closest to the body (1) designed in the form of a hollow truncated cone that has its top surface (12) turned toward the body (1) and with a changing slope of the generatrices of the conical surface and with the bottom and top surfaces (11, 12) with, on the lateral surface of the matrix (2), continuous radial grooves (13) that are connected to the outlet channels (9) of the body (1) through a cavity designed in the body.

2. Drilling apparatus of the cutting and shearing type according to claim 1, characterized in that the turbulence chamber (4) is designed in spherical shape.

3. Drilling apparatus of the cutting and shearing type according to claims 1 or 2, characterized in that the turbulence chamber (4) is equipped with a conical wave reflector (8) arranged in its upper part in the direction of its longitudinal axis, and that the conical taper ($\phi$) of the conical wave reflector (8) follows the relation $$0<\phi\leqq 20'$$

where $\phi$ is the conical taper of the wave reflector (8); and 0 is the critical angle of approach of a wave coming in to the wave reflector (8).

4. Drilling apparatus of the cutting and shearing type according to claims 1, 2 or 3, characterized in that the central outlet channel (6) is designed with a conical taper and its frontal surface (7) rounded off.

* * * * *

UNITED STATES PATENT AND TRADEMARK OFFICE

CERTIFICATE OF CORRECTION

PATENT NO. : 5,220,966
DATED : June 22, 1993
INVENTOR(S) : W.S. Awdujewski et al It is certified that error appears in the above-indentified patent and that said Letters Patent is hereby corrected as shown below:

On the Title page, the assignee should be changed from "Wave Tec G.m.b.H." to --Wave Tec Ges.m.b.H.--.

Col. 4, line 65, "94)" should be --(4)--.

Signed and Sealed this

Nineteenth Day of April, 1994

*Attest:*

*Attesting Officer*

BRUCE LEHMAN

*Commissioner of Patents and Trademarks*